United States Patent [19]

Castanino

[11] 4,249,335

[45] Feb. 10, 1981

[54] BUBBLE-BLOWING DEVICE

[76] Inventor: Joseph J. Castanino, 34 Lori La., East Bridgewater, Mass. 02333

[21] Appl. No.: 851,486

[22] Filed: Nov. 14, 1977

[51] Int. Cl.[3] ..... A63H 33/28

[52] U.S. Cl. ..... 46/6

[58] Field of Search ..... 46/6–8, 46/44

[56] References Cited

U.S. PATENT DOCUMENTS

| | | | |
|---|---|---|---|
| 673,488 | 5/1901 | Waterman et al. | 46/6 |
| 721,135 | 2/1903 | Allen | 46/6 |
| 721,373 | 2/1903 | Horton | 46/6 |
| 1,145,029 | 6/1915 | Munro | 46/7 UX |
| 1,526,052 | 2/1925 | Christian | 46/7 |
| 1,962,801 | 6/1934 | Bloxom | 46/7 |
| 2,205,028 | 6/1940 | Bloxom | 46/6 |
| 2,711,051 | 6/1955 | Pick | 46/6 |

FOREIGN PATENT DOCUMENTS

| | | | |
|---|---|---|---|
| 210777 | 3/1957 | Australia | 46/6 |

*Primary Examiner*—Gene Mancene
*Assistant Examiner*—Mickey Yu
*Attorney, Agent, or Firm*—Edward F. Perlman; Milton Oliver

[57] ABSTRACT

A bubble-blowing device enabling the formation of bubbles considerably larger than has been possible heretofore with less expenditure of energy, and further characterized by absence of moving parts, simplicity of operation, low cost and production of a greater number of bubbles per charge of bubble-blowing solution.

2 Claims, 5 Drawing Figures

BUBBLE-BLOWING DEVICE

BACKGROUND OF THE INVENTION

It is recognized that the size of a bubble blown from a film of "soap" solution depends to a major extent on the diameter of the opening upon the margin of which the bubble is formed. However, the larger the opening, the greater the energy required to form the film into a bubble of maximum diameter. Thus, a child will encounter greater difficulty because the capacity of the child's lungs is limited. For this reason, the production of larger bubbles may be said to be dependent on the child's lung-power.

SUMMARY OF THE INVENTION

I have found that bubbles having a diameter considerably larger than has heretofore been possible may be produced by the use of a tube open at one or both ends which may be charged with a suitable bubble-blowing solution, basically a soap solution, and by forcing a jet of air into the tube through a branch pipe. The desideratum is to so direct the jet as to cause it to impinge on the interior of the lateral wall of the tube at an acute angle thereto. In this way the incoming stream of air performs two functions: one, it sweeps air toward the front open end of the tube and, concurrently, forces the remainder of the air against the film of solution spanning the front open end of the tube, whereby the film is blown into a bubble enclosing considerable volume. By using a device in accordance with the invention having substantially the dimensions given hereinafter by way of example and an adequate charge of solution, bubbles as large as 20" diameter are readily obtained.

It will be appreciated that the child will derive pleasure from the larger bubbles in direct proportion to their size. This is demonstrated in the same way with bubble gum where the child will utilize his lungs to achieve the largest possible bubbles.

DESCRIPTION OF CERTAIN PREFERRED EMBODIMENTS

Figure 1:
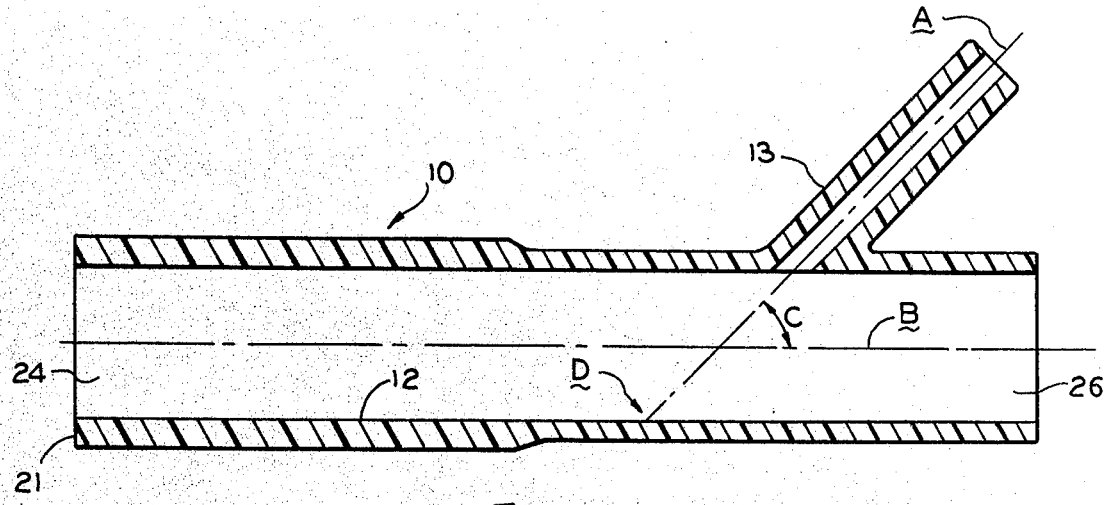
FIG. 1 is a longitudinal vertical cross section of one form of the device.
Figure 2:
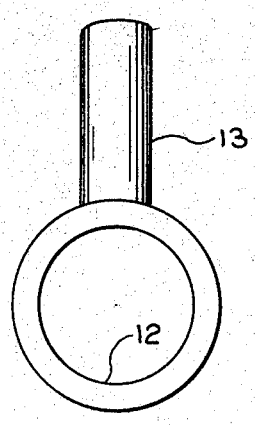
FIG. 2 is a front end elevation thereof.

Referring to the drawing, a basic form of the device comprises a tubular body 10 having a cylindrical, interior wall surface 12 provided with a laterally extending tubular mouthpiece 13 having an axis A which intersects the axis B of the body 10 at an angle C or, what amounts to the same thing, the wall surface 12 is intersected at an angle D supplementary to the angle C. The angle C is desirably between 30° and 60° and is so chosen as to assure that the axis A will fall within the length of the body. The length of the mouthpiece 13 is not critical but is selected so as to enable the child's lips to fit thereover with comfort. In any case, the device is prepared for the blowing of a bubble by dipping its front end 24 into any well-known solution, generally in the nature of a soap solution, whereupon a film of the solution will attach to the front end 21. The child then places the mouthpiece between his lips and blows a bubble by forcing a stream of air through the mouthpiece to impinge on the film.

The size of the bubbles may be regulated by closing the rear opening 26 to a greater or lesser degree thereby to by-pass a smaller or larger fraction of air flow through the body out of the rear opening than through the front opening. It will be understood that while blowing into the mouthpiece the body of the device will be held with the open front end facing downwardly, in order that the force of gravity may be availed of to yield larger bubbles.

Figure 3:
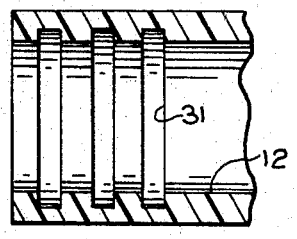
FIG. 3 is a transverse cross section of a portion of the front end of the device.
Figure 4:
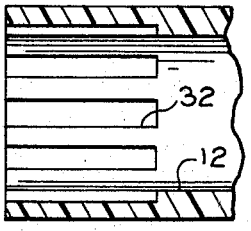
FIG. 4 is a transverse cross section of a portion of the front end of a modified form.

It will also be understood that the front end of the device may receive a larger charge of soap solution when the area available therefor is increased. FIGS. 3 and 4 show two ways in which the area available for attachment of the soap solution may be obtained. In FIG. 3 a plurality of circumferential grooves 31 are provided and, in FIG. 4, a plurality of axially-disposed grooves 32. A continuous helical groove may be used on the interior or exterior. In any case, the area to which the solution may attach is considerably amplified. If desired, the grooves of either FIGS. 3 and 4 may be on the exterior of the body or the grooves may be on both the interior and exterior.

Figure 5:
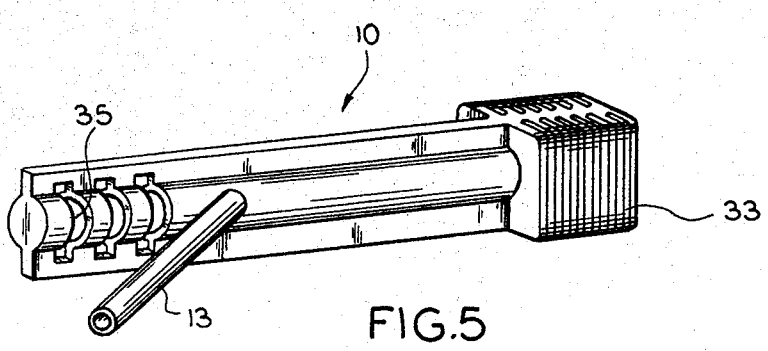
FIG. 5 is a perspective view of another form of the device.

In the embodiment of FIG. 5, the slits 33 and/or the slits 35 may be included to vary the air flow into or out of the interior of the body. For example, FIG. 5 shows three slots determining the inward flow of air carried to the interior of the device. Practical considerations may dictate a smaller or larger flow which may be carried out simply by increasing or decreasing the effective flow area.

I claim:

1. A bubble-blowing device comprising an elongated hollow body comprising a lateral wall and open at both ends, one end being adapted to be dipped into a bubble-blowing liquid to form a film thereof spanning the front end and a mouthpiece intersecting the lateral wall of the body at an acute angle, the vertex of the angle being toward the front end to supply air to the interior of the body, whereby the volume of air passing from the mouthpiece into the interior of the body flows principally to the front of the body to impinge on said film to form a bubble at said front end.

2. A bubble-blowing device comprising an elongated, hollow body having an open front end to be closed by a film of bubble-blowing solution spanning said front end, the opposite end of the body having at least one aperture for intake of air therefrom to blow the film into a bubble, the body having a substantially tubular mouthpiece extending outwardly therefrom with its axis disposed at an acute angle to the axis of the body, the vertex of the angle being directed toward the front end of the body to direct air blown through the mouthpiece essentially toward the film to form a bubble therefrom.

* * * * *